United States Patent [19]

Piretti

[11] Patent Number: 4,809,619

[45] Date of Patent: Mar. 7, 1989

[54] FOLDING TABLE

[75] Inventor: Giancarlo Piretti, Bologna, Italy

[73] Assignee: Pro-Cord S.r.l., Bologna, Italy

[21] Appl. No.: 80,338

[22] Filed: Jul. 31, 1987

[30] Foreign Application Priority Data

Aug. 7, 1986 [IT] Italy ..... 53741/86[U]
Jul. 1, 1987 [IT] Italy ..... 53494/87[U]

[51] Int. Cl.[4] ..... A47B 3/00

[52] U.S. Cl. ..... 108/115; 108/66; 108/112

[58] Field of Search ..... 108/115, 68, 66, 112, 108/114; 248/163.1, 167, 435

[56] References Cited

U.S. PATENT DOCUMENTS

| | | | |
|---|---|---|---|
| 340,176 | 4/1886 | Wardwell, Jr. | 108/66 X |
| 351,101 | 10/1886 | Fauber | 108/66 |
| 726,787 | 4/1903 | Turner | 108/112 |
| 1,040,330 | 10/1912 | Horner | 108/112 |
| 2,184,976 | 12/1934 | McFall | 108/66 X |
| 2,604,932 | 7/1952 | Leggett | 108/113 |
| 3,303,797 | 2/1967 | Mueller | 108/112 X |
| 3,490,394 | 1/1970 | Perkins et al. | 108/115 |
| 3,606,845 | 9/1971 | Hickman | 108/112 |
| 3,683,825 | 8/1972 | Sheldon | 108/66 X |
| 3,779,176 | 12/1973 | Piretti | 108/66 X |
| 4,046,084 | 9/1977 | Hosford et al. | 108/112 |

FOREIGN PATENT DOCUMENTS

| | | | |
|---|---|---|---|
| 220681 | 3/1909 | Fed. Rep. of Germany | 108/112 |
| 73897 | 9/1960 | France | 108/115 |
| 153426 | 2/1956 | Sweden | 108/66 |

*Primary Examiner*—Kenneth J. Dorner
*Assistant Examiner*—José V. Chen
*Attorney, Agent, or Firm*—Fuller, Puerner & Hohenfeldt

[57] ABSTRACT

A folding table (101) has a structure consisting of a plurality of mutually-articulated panels (104, 108, 109) which can be unfolded in an arc of a circle about an axis (105) corresponding to the central vertical axis of the table, from a folded configuration in which the structure is flattened in a meridian plane with respect to the above axis.

8 Claims, 11 Drawing Sheets

FOLDING TABLE

BACKGROUND OF THE INVENTION

The present invention relates to folding tables.

The object of the invention is to produce a folding table which can be converted from its condition of use to its folded condition and vice versa by simple and rapid operations, which is compact in the folded condition, and which has a relatively simple and reliable structure.

The principal characteristic of the table according to the invention lies in the fact that its structure is constituted by a plurality of mutually-articulated panels which can be unfolded in an arc of a circle about an axis corresponding to the central vertical axis of the table, from a folded configuration in which the structure is flattened in a plane containing this axis.

According to a further characteristic, the structure of the table comprises a first series of mutually-articulated panels which define the table-top and a second series of mutually-articulated panels which define a support structure for the table-top, the panels defining the table-top being further articulated alternately to the panels defining the support structure.

In a preferred embodiment, the panels defining the table-top are substantially in the shape of circular sectors and the panels defining the support structure for the table-top are arranged in planes containing the central vertical axis of the table and are articulated together adjacent this axis, the upper edge of each of these panels being articulated to the common edge of a respective pair of panels of the table-top whose upper surfaces come into contact with each other in the folded condition of the table. In a first embodiment, each pair of panels of the support structure is provided with a pair of auxiliary panels which are hinged together and have their opposite sides articulated to the two respective panels of the support structure, the auxiliary panels having upper edges which, in the condition of use of the table, constitute a supporting surface for the two overlying table-top panels whose lower surfaces come into contact with each other in the folded condition of the table.

By virtue of these characteristics, the structure of the table can be converted easily and rapidly from its condition of use to its folded condition and vice versa. In practice, the change from one condition to the other takes place by means of a single operation without the need for assembling or disassembling auxiliary parts. In the folded condition, the table assumes a compact configuration. Furthermore, the structure described above is simple and economical to construct and is highly reliable.

A further advantage of the table according to the invention lies in the fact that it is also arranged to assume an intermediate configuration between the completely folded condition and the condition of normal use, so that it can be positioned in a corner formed by two walls (the table-top corresponding to a circular sector having an angle of opening of 90°or against a wall (the table-top corresponding to a circular sector having an angle of opening of 180°).

In a second embodiment, an auxiliary panel interposed between each pair of adjacent vertical panels is connected in an articulated manner to the vertical panels adjacent the vertical axis of the table and has an upper edge which supports—in the unfolded condition of the table—a respective pair of table-top panels whose lower surfaces come into contact with each other in the folded condition of the table.

Further characteristics and advantages of the invention will become clear from the description which follows with reference to the appended drawings, provided purely by way of non-limiting example.

DESCRIPTION OF A PREFERRED EMBODIMENT

Figure 1:
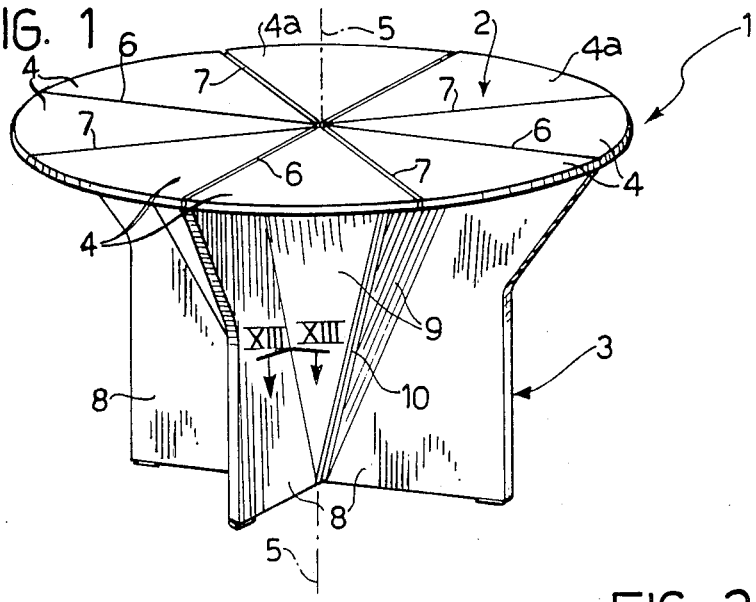
FIG. 1 is a perspective view of a first embodiment of the new depicted i its unfolded condition in which it is ready for normal use.
Figure 2:
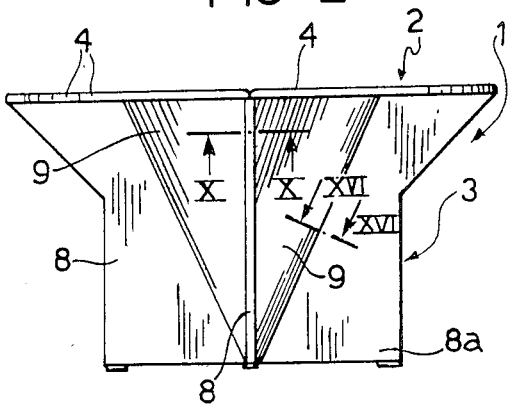
FIGS. 2, 3 and 4 illustrate a side elevational view, a plan view and a view from below of the table of FIG. 1.
Figure 3:
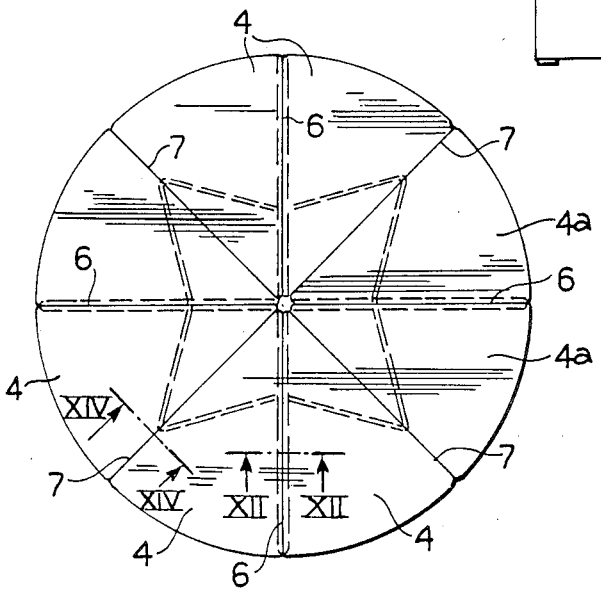
Figure 4:
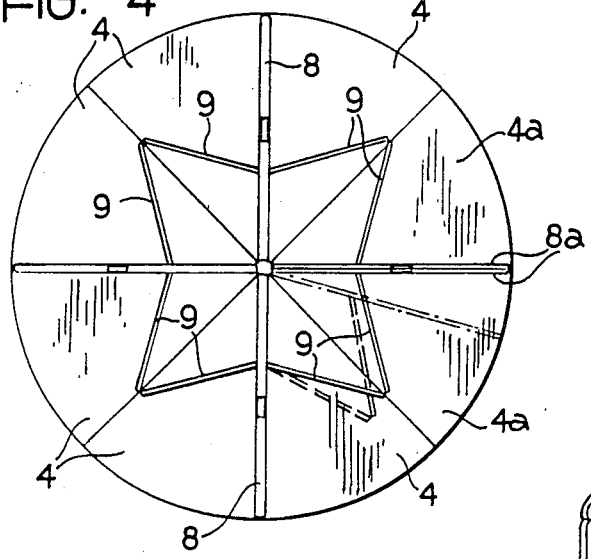
Figure 5:
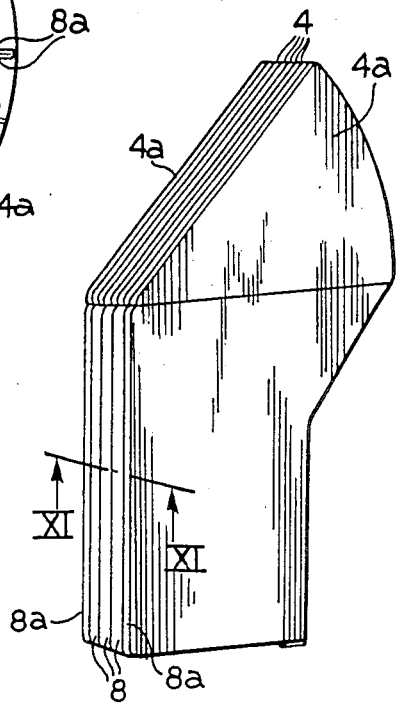
FIG. 5 shows the table of FIG. 1 in the completely folded condition.
Figure 6:
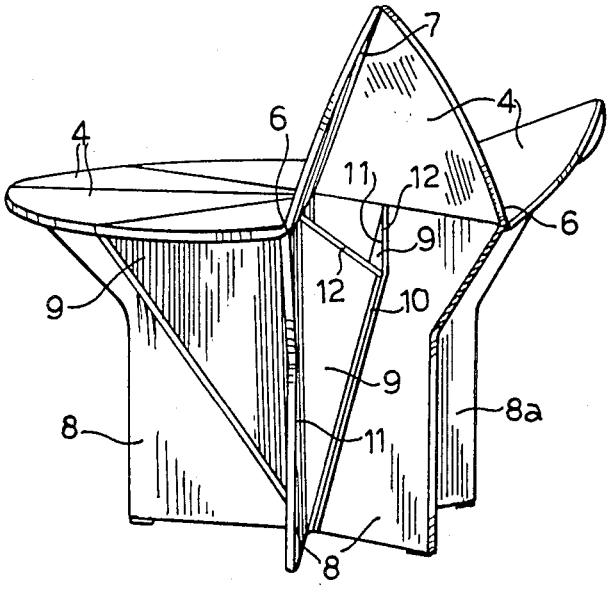
FIGS. 6, 7, 8 and 9 are perspective views which show four intermediate configurations which the table assumes successively when it is converted from the configuration of normal use of FIG. 1 to the completely folded configuration of FIG. 5.
Figure 7:
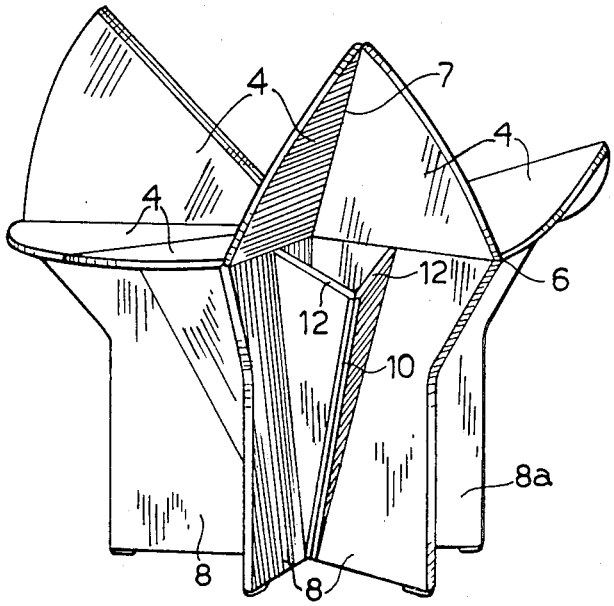
Figure 8:
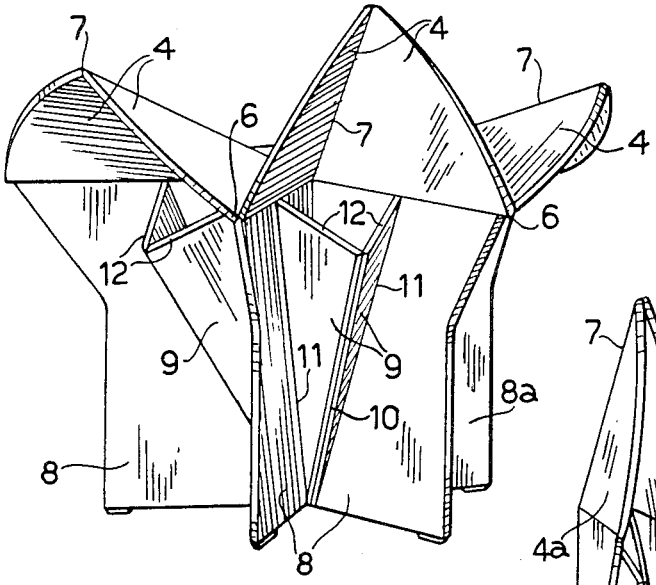
Figure 9:
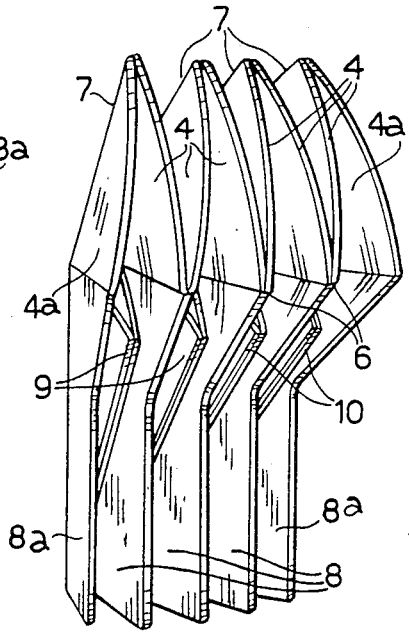

FIGS. 1–17 illustrate a folding table 1 which, in the configuration of normal use (FIG. 1), has a table-top 2 and a structure 3 for supporting the table-top 2. The table-top 2 consists of a plurality of panels 4 in the form of circular sectors having radial sides converging towards the central vertical axis of the table, indicated 5. The example illustrated relates to the case in which the external circumferences of the sector-shaped panels 4 are arranged in a single circumference having its centre on the axis 5, so that the table-top is circular in the unfolded condition of the table illustrated in FIG. 1. However, it is clear that the panels 4 could be shaped so that, in the unfolded condition of the table, they would form a table-top of different shape, for example, square, rectangular, or oval. All the panels 4 of the table-top are articulated together like an accordion at their contiguous radial sides, with the exception of the two panels indicated 4*a* in FIG. 1. These panels 4*a* are not connected to each other, but only to the two respective panels 4 next to them. The structure of the table-top 2 can therefore be folded like an accordion, starting from the configuration illustrated in FIG. 1, by means of a circular arcuate movement about the axis 5. During this movement, the two panels 4*a* move progressively away from each other. The articulations between the panels 4 and 4*a* are alternately indicated by 6 and 7 in FIG. 1. In the folded condition of the table (see FIGS. 9, 5), the upper surfaces of the two panels 4 adjacent each articulation 6 are in contact with each other, while the lower surfaces of the two panels adjacent each articulation 7 are in contact with each other.

The structure 3 for supporting the table-top 2 comprises a plurality of vertical panels 8 articulated together adjacent the central axis 5 of the table and arranged in meridian planes relative to this axis. Two of these panels, indicated 8*a* in the drawings, are not connected to each other, but only to the two respective panels 8 next to them. With the table in the unfolded condition, the two panels 8*a* are beside each other and the pair of panels 8*a* and the three further panels 8 are disposed at 90° to each other (see FIGS. 4, 10). The thickness of each of the panels 8*a* preferably corresponds to half the thickness of the panels 8 so that, in the condition of normal use of the table, the support structure 3 appears to consist of four panels of equal thickness located at 90° from each other.

The upper edges of the three vertical panels 8 are articulated to the three hinges 6 of the table-top, while the upper edges of the two panels 8*a* are articulated to the free radial edges of the two panels 4*a*. As a result of this structure and arrangement, when the table-top is folded like an accordion from its condition of normal use, the panels of the support structure 3 rotate about their respective articulations adjacent the vertical axis 5 of the table and are brought into the condition illustrated in FIG. 5, in which they are side by side. This movement occurs naturally as the end panels 8*a* move progressively apart.

In order to ensure the necessary support of the panels 4 of the table-top at the hinges 7, when the table is in the unfolded condition, each pair of adjacent vertical panels of the structure 3 is provided with a further pair of triangular auxiliary panels 9 which are hinged together at a common edge 10 and have their opposite edges 11 articulated to the two respective panels 8. The two panels 8*a* are an exception, of course, no pair of auxiliary panels being provided between them since the panels 8*a* must be completely separable from each other to enable the table to be folded. With the table in the configuration of normal use, the upper edges of the auxiliary panels 9, indicated 12, constitute a supporting surface for the two panels 4 immediately above. The stability of the table-top 2 is thus ensured in the configuration of normal use of the table.

FIGS. 10 to 17 of the appended drawings illustrate in detail the structural details of the table described above in a preferred embodiment. It is clear that these structural details could also be varied, without thereby departing from the scope of the invention.

Figure 10:
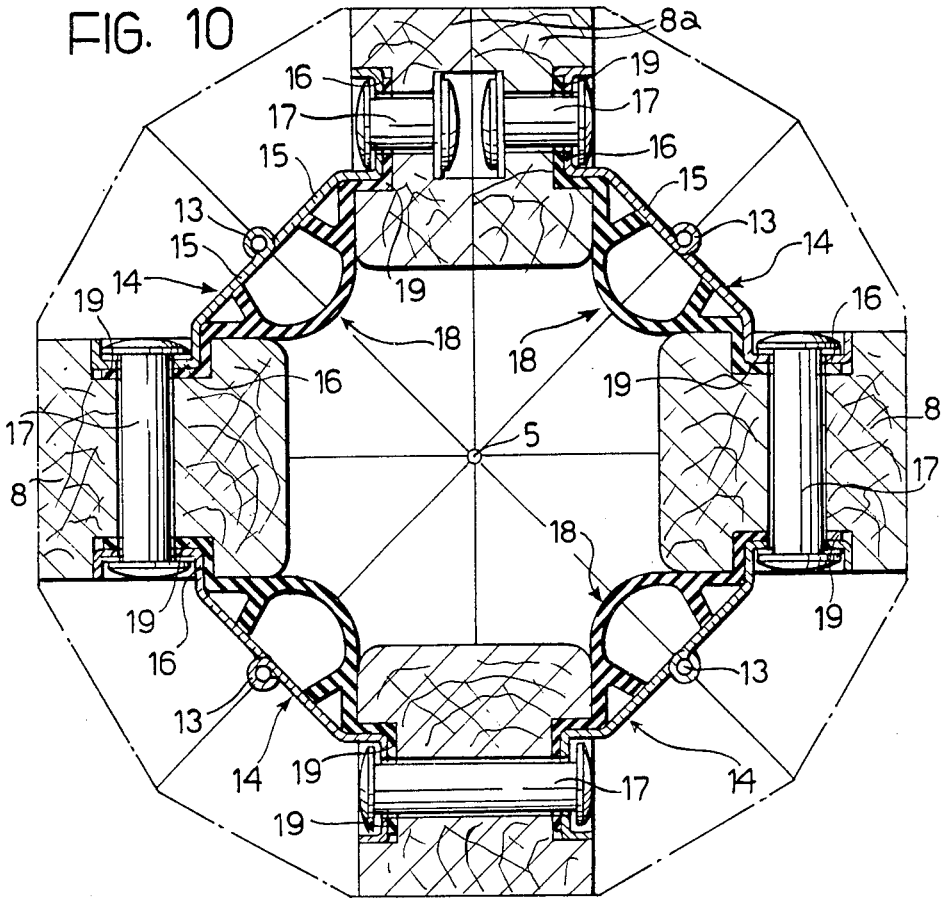
FIG. 10 is a section taken on the line X—X of FIG. 2, on an enlarged scale.
Figure 11:
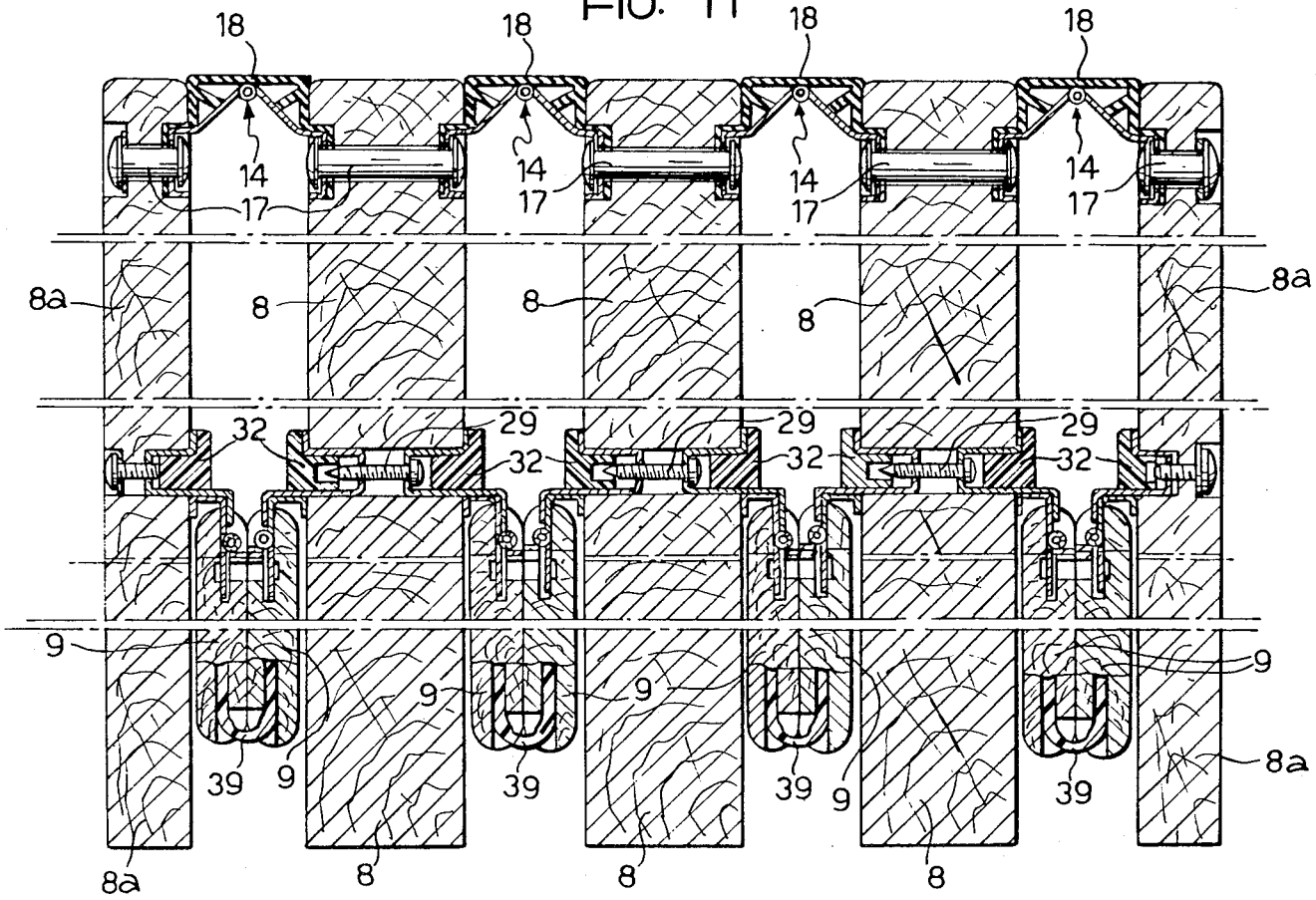
FIG. 11 is a section taken on the line XI—XI of FIG. 5, on an enlarged scale.

With reference to FIG. 10, the panels 8, 8*a* of the support structure 3 are articulated together about four vertical axes 13 equidistant from the central vertical axis 5 of the table. Each articulation 13 is achieved by means of a conventional metal hinge 14 consisting of two hinge elements 15 forming holes in which an articulation pin is engaged and extending for the entire height of the panels 8, 8*a*. The two hinge elements 15 of each hinge 14 have lateral flanges 16 which are fixed to the respective panels 8, 8*a* by means of rivets 17. In order to conceal the metal hinges 14 from view when the table is in the folded condition, a shaped element 18 of deformable elastomeric material is associated with each hinge 14 and also has longitudinal flanges 19 fixed to the respective panels 8, 8*a* by means of the rivets 17. FIG. 11 illustrates the detail of FIG. 10 in the folded condition of the table, with the elements 18 in their deformed condition.

Figure 12:
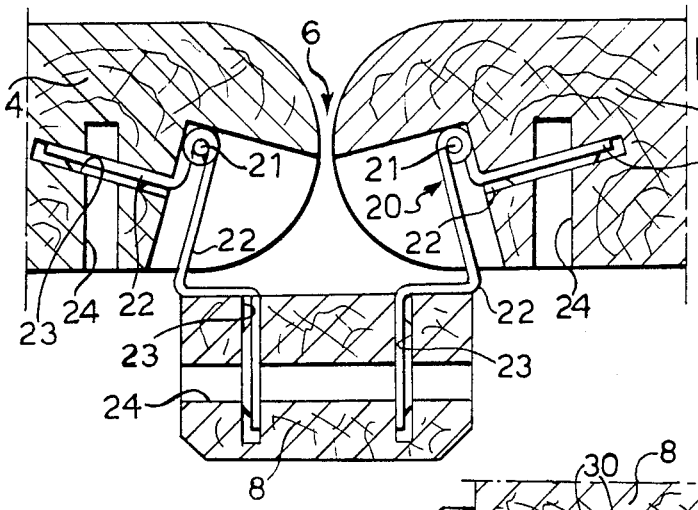
FIG. 12 is a section taken on the line XII—XII of FIG. 3, on an enlarged scale.

FIG. 12 illustrates in section the detail of the articulation 6 between two contiguous panels 4 of the table-top. As can be seen from FIG. 12, the articulation 6 between the two panels is actually achieved by a pair of hinges 20, by means of which the two panels 4 are respectively articulated to the respective panel 8 of the support structure 3 about two parallel axes 21. Each of the two hinges 20 comprises two sheet-metal hinge elements 22 having flanges inserted in channels 23 formed in the panels 4 and 8. Holes 24 are also formed in these panels to provide access, for a tool, not shown, intended to be pressed against the flanges 22 to deform them and prevent the flanges from coming out of the channels 23.

Figure 13:
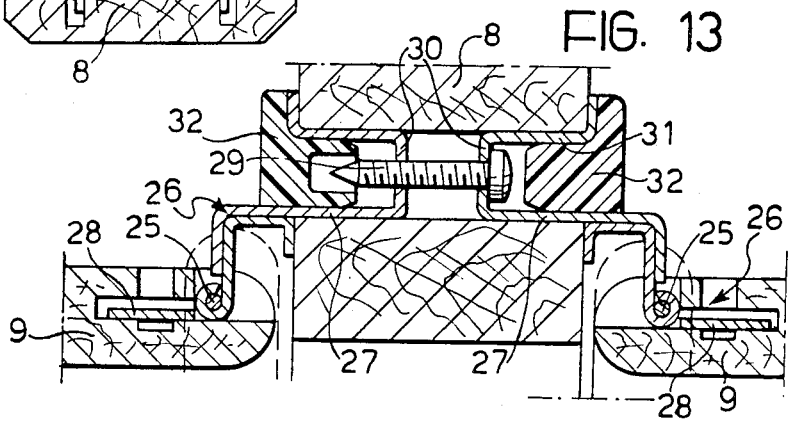
FIG. 13 is a section taken on the line XIII—XIII of FIG. 1 on an enlarged scale.

FIG. 13 shows the connection of the two auxiliary panels 9 associated with a panel 8 of the support structure 3. Each panel 9 is articulated to the panel 8 about an axis 25 by means of a metal hinge 26 having a hinge element 27 connected to the panel 8 and a hinge element 28 connected to the panel 9, in a manner similar to that illustrated for the elements for the elements 22 of FIG. 12. The two hinge elements 27 associated with the panel 8 are connected together by means of a screw 29 which engages two cup-shaped appendages 30 inserted in a through-hole 31 whose ends are closed by two elements 32 of plastics material.

Figure 14:
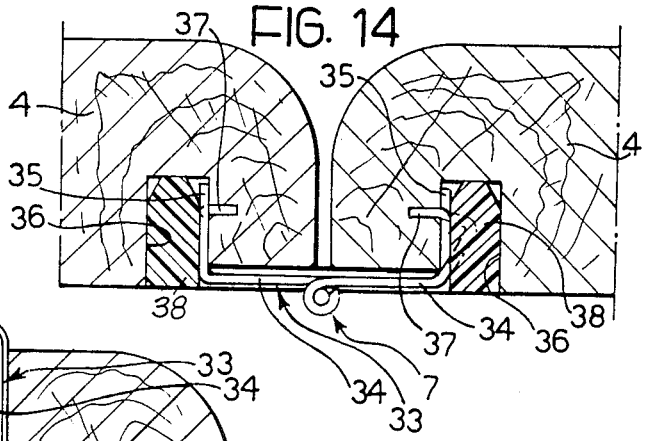
FIG. 14 is a section taken on the line XIV—XIV of FIG. 3 on an enlarged scale.
Figure 15:
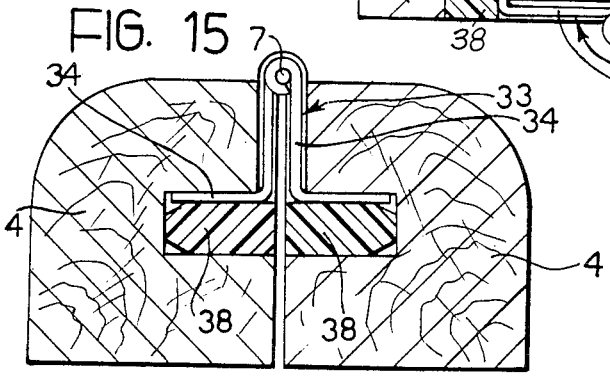
FIG. 15 shows the detail of FIG. 14 in the folded condition of the table.
Figure 18:
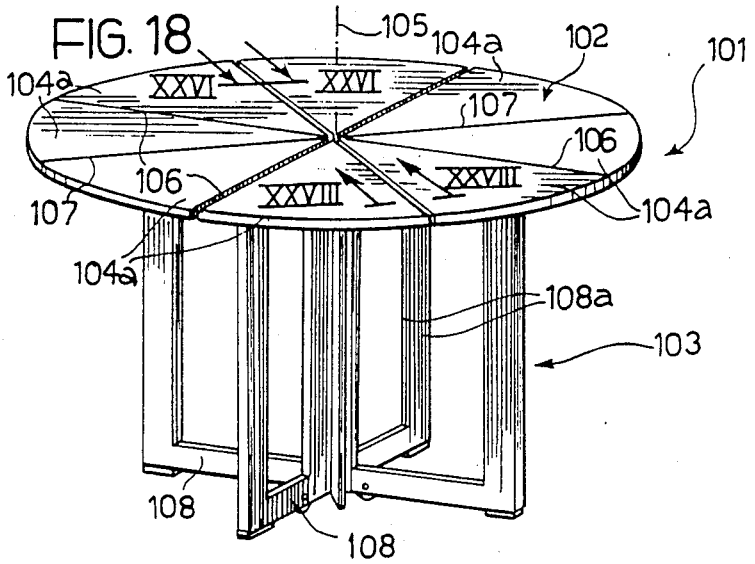
FIG. 18 is a perspective view of an alternative embodiment of the table according to the invention in the condition of use, FIGS. 19 to 21 respectively are an elevational view, a plan view and a view from below of the table of FIG. 18 in the condition of use.
Figure 19:
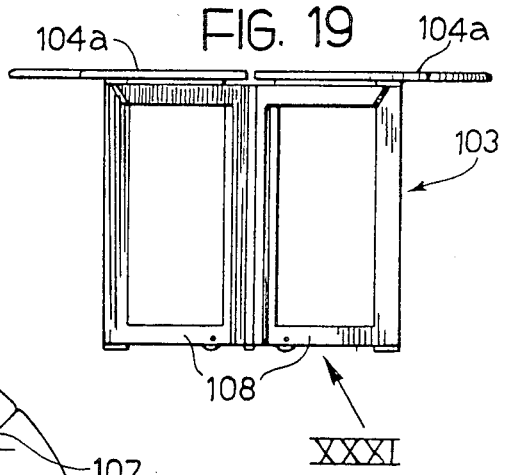
Figure 20:
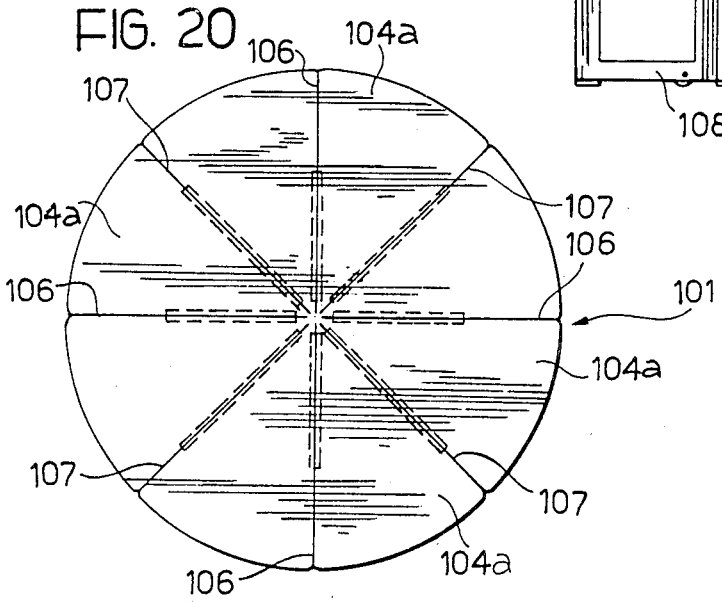
Figure 21:
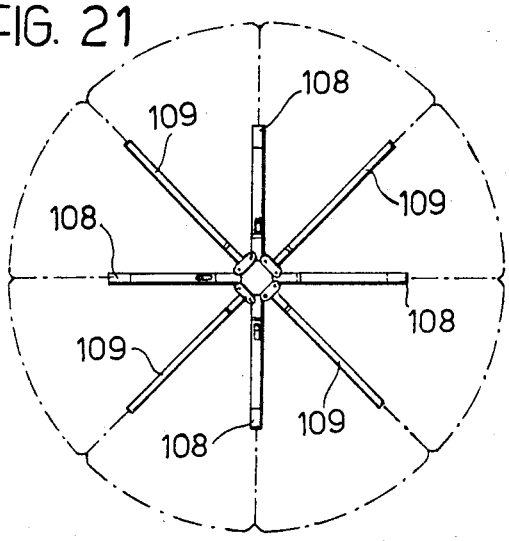

FIGS. 14 and 15 are sections showing the articulation 7 between two panels 4 of the table top in the condition of normal use and in the folded condition of the table respectively. This articulation, achieved by means of a hinge 33, comprises two sheet-metal hinge elements 34 having flanges 35 inserted in holes 36 formed in the panels 4. Each flange 35 is provided with a lip 37 which is engaged in the body of the panel. This engagement occurs as a result of the insertion into each of the holes 36 of a plastics body 38 which causes deformation of the flange 35 from the undeformed condition illustrated by broken lines on the right-hand side of FIG. 14.

Figure 16:
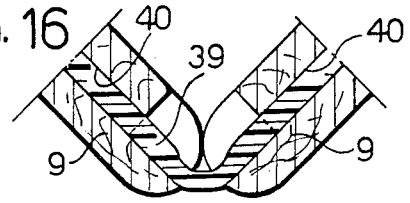
FIG. 16 is a section taken on the line XVI—XVI FIG. 2, on an enlarged scale.
Figure 17:
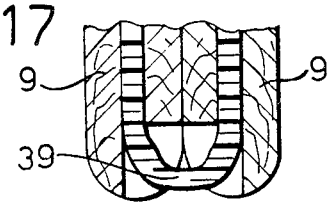
FIG. 17 shows the detail of FIG. 16 in the folded condition of the table.

FIGS. 16 and 17 illustrate in section, in the extended and folded section respectively, the mutual articulation of two auxiliary panels 9, which is achieved by means of a sheet of deformable elastomeric material 39 having longitudinal edges fixed in channels 40 formed in the panels 9.

FIGS. 18 to 31 of the appended drawings illustrate a second embodiment of the table according to the invention. In this drawing, the parts common or corresponding to those of FIGS. 1–17 are indicated with the same reference numerals increased by 100.

A first difference with respect to the table of FIGS. 1–17 lies in the fact that, while the table-top 102 preferably consists of wood, each panel 108 has a frame structure consisting of metal box-section members. A further difference lies in the fact that, in order to ensure the necessary support for the panels 104 of the table-top at the hinges 107 when the table is in the condition of normal use, an auxiliary panel 109 is interposed between each pair of adjacent vertical panels 108. In the case of the embodiment illustrated, this panel has a right angle arm **109*b* and has a vertical arm 109*a* articulated to the respective pair of vertical panels 108 adjacent the axis 105 of the table and a horizontal arm 109*b* for supporting the two panels 104** immediately above.

Figure 24:
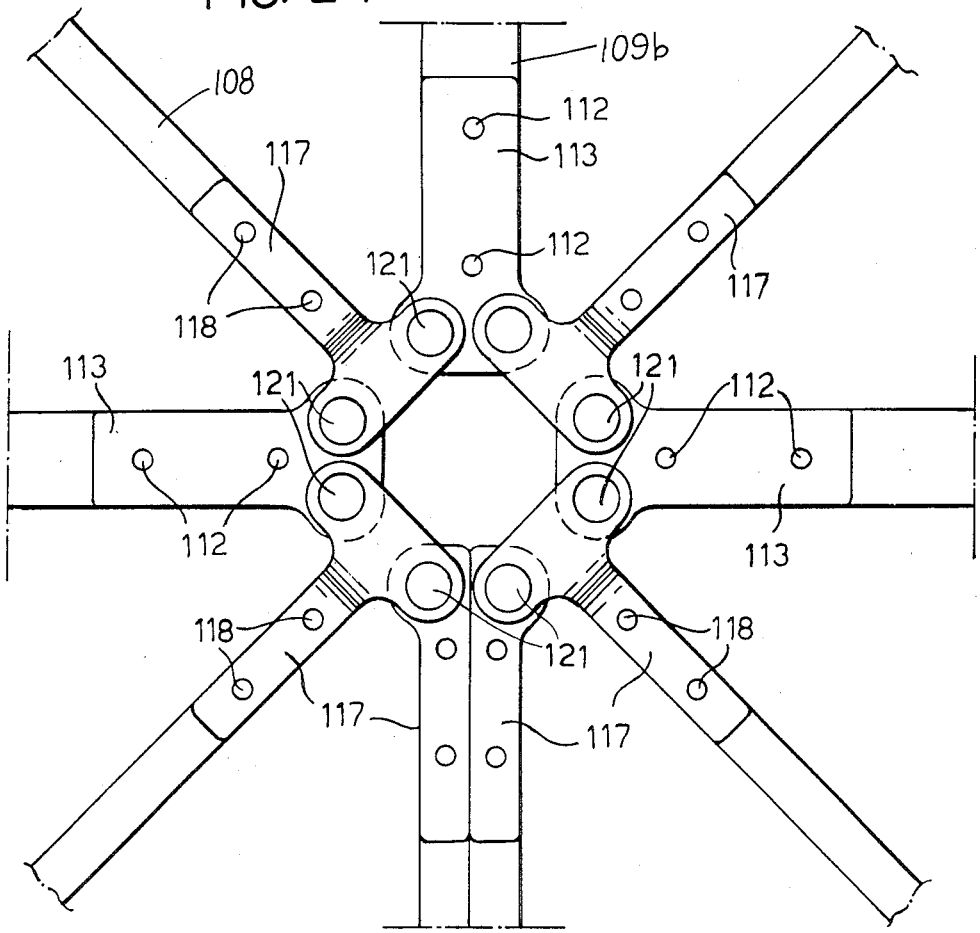
FIG. 24 is a detail of FIG. 21 on an enlarged scale.
Figure 25:
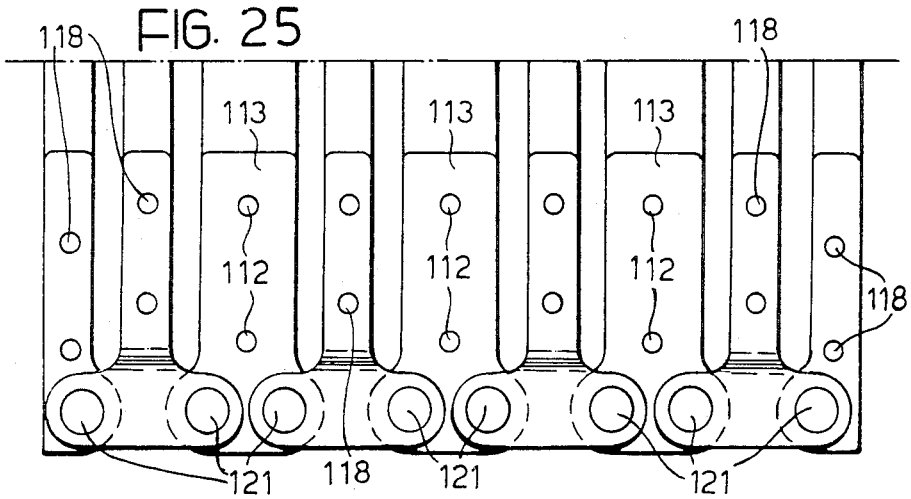
FIG. 25 shows the detail of FIG. 24 in the folded condition of the table.
Figures 30, 31:
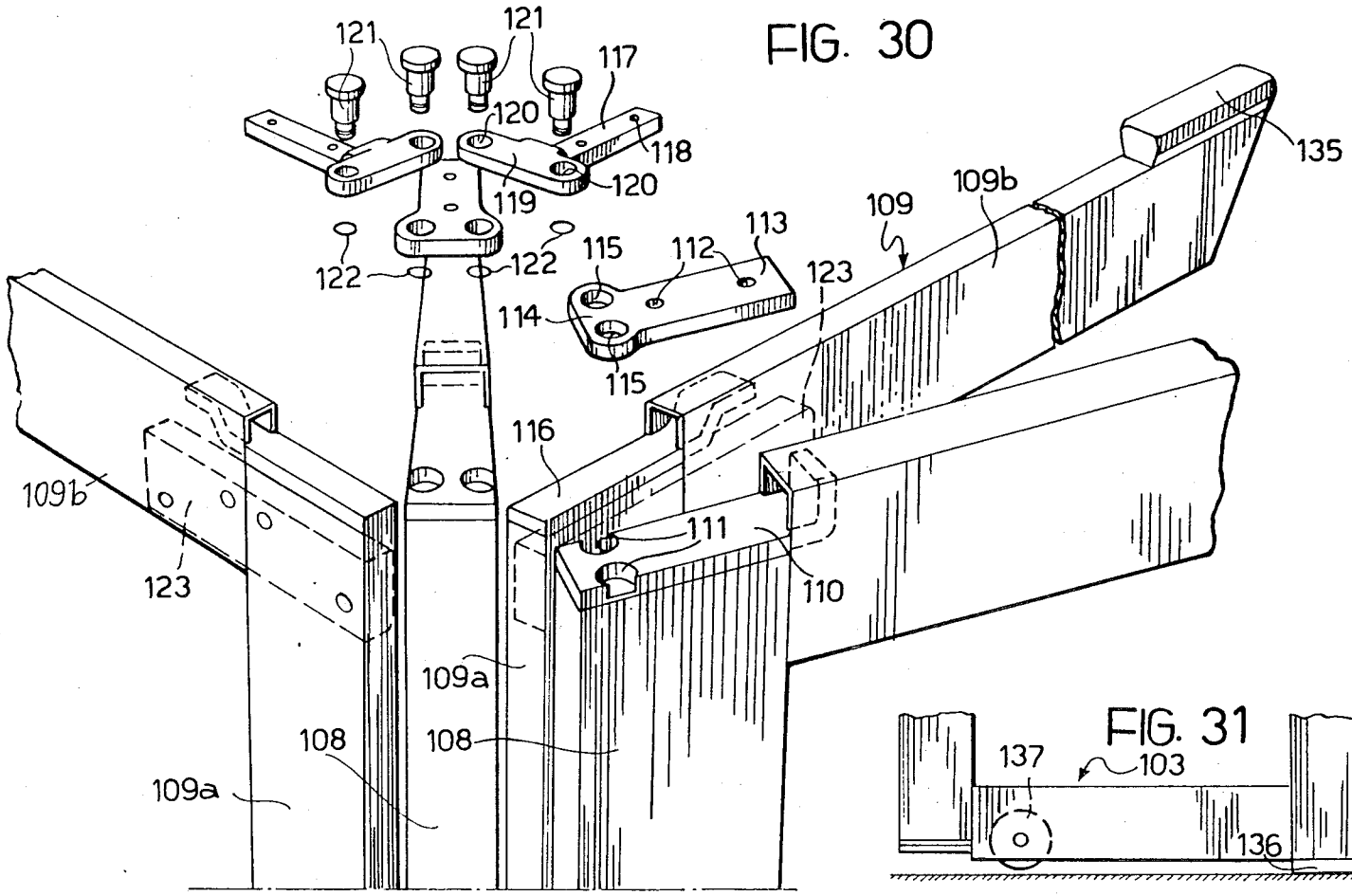
FIG. 30 is an exploded perspective view of the detail shown in FIG. 24.
FIG. 31 shows the detail XXXI of FIG. 19.

The mutual articulation of the panels 108 and 109 is achieved at both the upper edges and the lower edges of the panels, as illustrated in detail in FIGS. 24 and 30. As can be seen, each panel 108 is provided at the opposite ends of its inner vertical arm (the drawings illustrate only the upper end) with a reinforcing plate 110 which is welded to the structure of the panel and has two circular holes 111 with vertical axes. A plate-shaped hinge element 113 is fixed to each plate 110 by means of screws (not illustrated) which engage holes 112, and has a T-shaped head 114 with two holes 115 which are aligned with the two holes 111. In its turn, each intermediate panel 109 is provided at the upper and the lower ends of its vertical arm **109*a* with a reinforcing plate 116 on which is fixed a hinge element 117, also plate-shaped, fixed to the plate 116 by means of screws (not illustrated) which engage holes 118. The plate 117 has a T-shaped head 119 with holes 120. When the table is in the assembled condition, the heads 119 are partially superimposed on the adjacent heads 114, so that each hole 120 is aligned with the respective hole 115 of the adjacent head 114. The hinge elements 113, 117 are articulated to each other by means of articulation pins 121 which engage the aligned holes. Each pin 121 has an enlarged head which rests on the respective head 119 and is held in position axially by means of circlips 122**.

Figure 26:
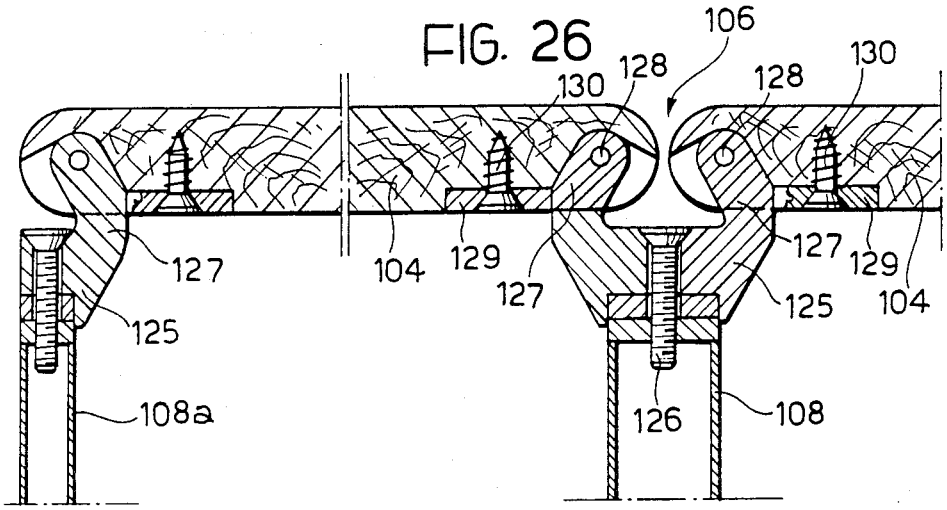
FIG. 26 is a section taken on the line XXVI of FIG. 18.

As seen in FIGS. 26 and 30, the structure of the panels 108, 109 consists of metal box-sections welded together. In the case of the panels 109, the connection between the upper arm **109*b* and the lower arm 109*a* is further stiffened by means of an internal connecting element 123** welded to both arms of the panel.

FIG. 26 illustrates the connection of a panel 108 to the respective hinge 106. As can be seen, an element 125 is fixed to the upper edge of each panel 108 by means of screws 126 and has two arms 127. The respective panels 104 of the table-top are provided with metal plates 129 fixed by means of screws 130 and articulated at 128 to the two arms 127. In the case of each panel **108*a*, the part 125 is provided with a single arm 127 having a symmetrical configuration with respect to that of the part 125 of the other panel 108*a***.

Figure 27:
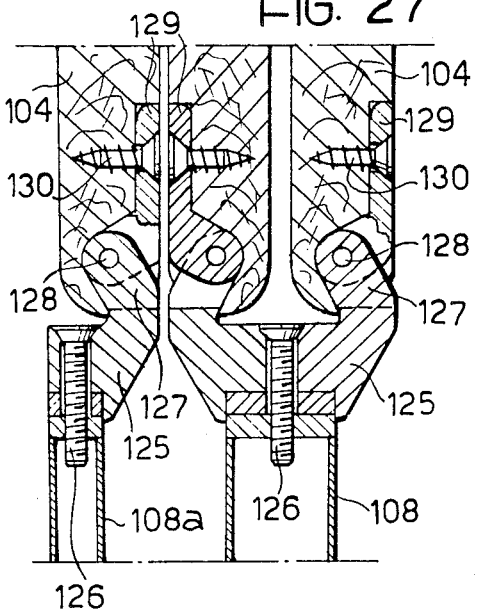
FIG. 27 shows the detail of FIG. 26 in the folded condition of the table.

FIG. 27 illustrates the structure of FIG. 26 in the folded condition of the table.

Figure 29:
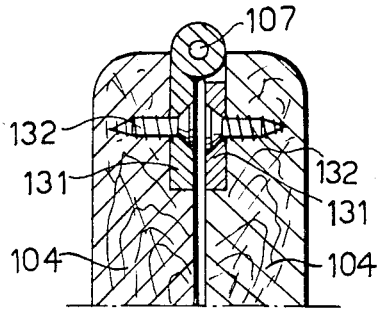
FIG. 29 shows the detail of FIG. 28 in the folded condition of the table.
Figure 28:
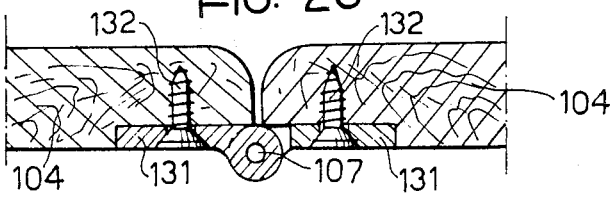
FIG. 28 is a section taken on the line XXVIII of FIG. 18.

FIGS. 28 and 29, however, illustrate a hinge 107 of the two panels 104 of the table in the open condition and in the folded condition. As can be seen, the two hinge elements consist of two metal plates 131 fixed to the panels 104 by means of screws 132.

Figure 23:
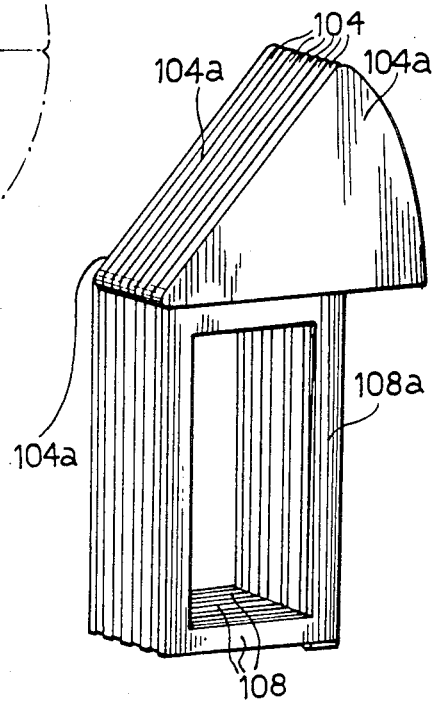
FIG. 23 is a perspective view of the table in the completely folded condition.
Figure 22:
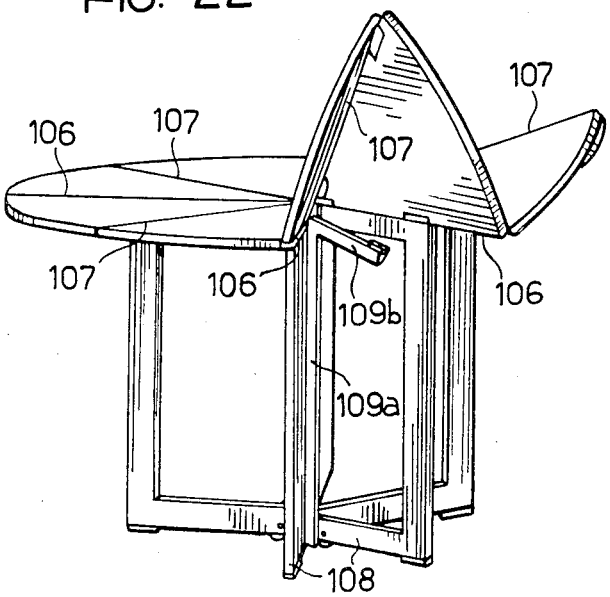
FIG. 22 is a perspective view of the table of FIG. 18 in a partially folded condition.

With reference to FIG. 30, the upper arm **109*b* of each intermediate panel 109 is provided at its outer end with an element 135, for example of plastics material, for supporting the overlying panels of the table-top. With reference to FIG. 31, the lower arm of each panel 108 is provided at its outer end with a supporting foot 136, for example of plastics material, and at its inner end with a wheel 137 which, however, is not in contact with the floor when the table is open with the feet 136 resting on the floor. On the other hand, when the table is folded, as illustrated in FIG. 23, the flattened unit thus obtained rests both on its feet 136, which are side by side, and on the wheels 137**, enabling the folded table to be moved easily.

What is claimed is:

1. A folding table comprising:

a series of table-top panels having opposite side edges, said table-top panels being arranged with said side edges adjacent each other to form joints between adjacent panels and said table-top panels being arranged about a central vertical axis and in a common horizontal plane to provide a table-top, a series of generally vertical support panels comprising a support structure, said support panels each having a top edge and a vertical side edge, the side edges being arranged around said vertical axis and said support panels being coincident with substantially vertical planes directed through said axis when the table is unfolded, corresponding adjacent side edges of adjacent pairs of support panels being hingedly connected to provide an articulated support structure and provide for folding said support panels mutually toward each other, edges of first pairs of table-top panels adjacent every other one of said joints being hingedly connected to provide for folding said table-top panels toward each other and alternate edges of second pairs of table-top panels at other ones of said joints between said every other one being hingedly connected to themselves and to said top edges of the vertical support panels to provide for folding of the second table-top panels toward said first table-top panels so as to enable folding table-top panels and support panels into common planes to produce a compact folded table, said adjacent edges of two of the adjacent table-top panels being completely separate from each other so that when the other table-top panels are folded against each other, said adjacent separate panels are situated at opposite ends of the pack of panels in the flattened, folded condition of the table.

2. A table according to claim 1, wherein the panels defining the table-top are substantially in the shape of circular sectors.

3. A table according to claim 1 including a pair of auxiliary panels each having pairs of side edges, corresponding side edges on each auxiliary panel being hinged together and opposite side edges being hingedly connected to the two respective panels of the support structure, the auxiliary panels having upper edges which, when the table is unfolded are positioned respectively under two overlying table-top panels for supporting said table-top panels.

4. A table according to claim 1, including an auxiliary intermediate panel interposed between each pair of adjacent vertical support panels, the auxiliary intermediate panel being hingedly connected to the vertical panels adjacent said vertical axis of the table and said auxiliary panels having an upper edge for supporting, in the unfolded condition of the table, a respective pair of table-top panels whose lower surfaces come into contact with each other in the folded condition of the table.

5. A table according to claim 4, wherein said auxiliary panels are comprised of vertical arms which are hingedly connected to vertical panels as aforesaid and horizontal arms extending at right angles respectively from the vertical arms for supporting the overlying panels of the table-top.

6. A table according to claim 5, including plate-like hinge elements each having a T-shaped head with two holes for the engagement of articulation pins, said hinge elements being mounted to the upper and lower edges of vertical and auxiliary panels.

7. A table according to claim 4, wherein said vertical panels are comprised of metal box-section members arranged as upper and lower horizontal arms and a pair of vertical arms joined together to form a rectangular frame.

8. A table according to claim 7, wherein the lower arm of each vertical panel has a supporting foot at its outer end and has a wheel at its hinged inner end, the wheel projecting from the lower edge of the vertical panel for a distance less than the height of the supporting foot.

* * * * *